US010494833B2

(12) United States Patent
Catteeuw

(10) Patent No.: US 10,494,833 B2
(45) Date of Patent: Dec. 3, 2019

(54) SECURITY FENCE PANEL AND SECURITY FENCE

(71) Applicant: BETAFENCE HOLDING NV, Ghent (BE)

(72) Inventor: Bart Korneel Alfons Catteeuw, Zwevegem (BE)

(73) Assignee: GUARDIAR EUROPE, Zwevegem (BE)

( * ) Notice: Subject to any disclaimer, the term of this patent is extended or adjusted under 35 U.S.C. 154(b) by 136 days.

(21) Appl. No.: 14/648,660

(22) PCT Filed: Nov. 26, 2013

(86) PCT No.: PCT/IB2013/060400
§ 371 (c)(1),
(2) Date: May 29, 2015

(87) PCT Pub. No.: WO2014/083497
PCT Pub. Date: Jun. 5, 2014

(65) Prior Publication Data

US 2015/0315809 A1 Nov. 5, 2015

(30) Foreign Application Priority Data

Nov. 29, 2012 (BE) ..... 2012/0809

(51) Int. Cl.
*E04H 17/16* (2006.01)
*E04H 17/04* (2006.01)
*E04H 17/24* (2006.01)

(52) U.S. Cl.
CPC ..... *E04H 17/161* (2013.01); *E04H 17/04* (2013.01); *E04H 17/24* (2013.01)

(58) Field of Classification Search
CPC ..... E04H 17/04; E04H 17/161; E04H 17/24; E04H 17/02; E04H 17/163
USPC ..... 256/24, 28, 29, 32, 33, 47, 48, 57, 58, 256/65.01
See application file for complete search history.

(56) References Cited

U.S. PATENT DOCUMENTS 590,357 A * 9/1897 Church ..... E04H 17/04 256/45
642,109 A * 1/1900 Green ..... E04H 17/06 256/58
762,645 A * 6/1904 May ..... E04H 17/06 256/32
1,071,822 A * 9/1913 Storey ..... E04B 9/127 109/33

(Continued)

FOREIGN PATENT DOCUMENTS

DE 202011003354 U199 * 5/2011 ..... E04H 17/161
DE 102010025513 A1 12/2011

(Continued)

*Primary Examiner* — Josh Skroupa
(74) *Attorney, Agent, or Firm* — Symubs Law Group, LLC; Clifford D. Hyra

(57) ABSTRACT

A security fence panel (2), where wires (2*a*) of a first set of parallel wires (2*a*, 2*b*) are arranged on the other side of a second set of parallel wires (2*c*) from, and are arranged at a spacing from, the rest (2*b*) of the wires of the first set (2*a*, 2*b*), and the wires from the first set (2*a*, 2*b*) cross the wires from the second set (2*c*) and are welded thereto at the points of intersection. A security fence (1) comprising such a security fence panel (2).

15 Claims, 3 Drawing Sheets

(56) References Cited

U.S. PATENT DOCUMENTS

| | | | | | |
|---|---|---|---|---|---|
| 1,892,572 | A * | 12/1932 | Haehl | E04H 17/24 | 256/3 |
| 4,723,759 | A * | 2/1988 | Patrick | E04H 17/161 | 256/22 |
| 5,275,382 | A * | 1/1994 | Charbaut | E04H 17/161 | 256/48 |
| 6,010,116 | A * | 1/2000 | Knott, Sr. | E04H 17/161 | 256/24 |
| 8,840,089 | B2 * | 9/2014 | Walker | A01K 3/005 | 256/10 |
| 2003/0145799 | A1 * | 8/2003 | Hays | A01K 1/034 | 119/502 |
| 2003/0209701 | A1 * | 11/2003 | Goddard | E04H 17/20 | 256/47 |
| 2006/0237704 | A1 * | 10/2006 | Rodenburg | E04H 17/161 | 256/24 |
| 2008/0308780 | A1 * | 12/2008 | Sloan | E01F 13/12 | 256/31 |
| 2011/0062404 | A1 * | 3/2011 | Shepherd | E04H 17/161 | 256/34 |
| 2011/0079761 | A1 * | 4/2011 | Young | E04H 17/161 | 256/24 |
| 2011/0114910 | A1 * | 5/2011 | Stuckel | E04H 17/10 | 256/24 |

FOREIGN PATENT DOCUMENTS

| | | | |
|---|---|---|---|
| EP | 2194216 | A1 | 6/2010 |
| GB | 2480913 | A | 12/2011 |
| ZA | 2005/08877 | A | 12/2005 |
| ZA | 2006/09593 | A | 8/2008 |

* cited by examiner

SECURITY FENCE PANEL AND SECURITY FENCE

This application claims the benefit of Belgian patent applications No. BE2012/0809, filed Nov. 29, 2012, which is hereby incorporated by reference in its entirety.

FIELD OF THE INVENTION

The present invention relates to a security fence panel, comprising a first set of wires extending substantially parallel to one another and a second set of wires extending substantially parallel to one another, wherein the wires from the first set and the second set intersect and, where these intersect, are mutually welded. In addition, the present invention relates to a security fence comprising such a security fence panel.

BACKGROUND

In this patent application, the term 'wires' is used in the sense of an elongate element or rod-shaped element.

By the term 'weld' is understood any operation or treatment, whether or not with the addition of welding materials or gluing materials or products and whether or not accompanied by a (local) heating of the parts to be connected, which creates a durable connection without external coupling means and with a substantially mechanical connecting function.

Fences as described in EP 2 194 216 A1 and DE 10 2010 25 513 A1 are not security fences of the type to which the present invention relates, since they cannot largely prevent penetration by persons.

The clamps from the fence from EP 2 194 216 A1 can be easily broken, the wires from the fence panels from this fence can be easily cut through, and a person can easily climb over such a fence, so that the fence which is herein described cannot reliably be used to prevent penetration by persons.

Since the fence panels from the fence as described in DE 10 2010 25 513 A1 can be easily hooked together, they can also easily be unhooked from one another again, so that it is particularly easy for persons to force their way through this fence.

Security fences having security fence panels to which the present invention relates are generally erected around buildings or areas to be protected. Thus such fences are erected, for example, around military installations, nuclear installations, airports, etc. These security fences here serve to prevent persons from being able to get through to these buildings or areas, yet ensure satisfactory visibility through these fences. With such fences, it can generally be ensured that for a certain period persons are unable to break through or climb over the fence using simple hand tools. Such a fence is also generally provided with a detection system which generates an alarm signal in the event of an attempt to break through or climb over this fence. Alternatively or additionally, security staff keep sight of the fence, whereby they can observe these attempts through the fence. The said period should then preferably tally with the period within which security staff can reach the site.

Wire panels having perpendicularly intersecting wires and an appropriate mesh size are already commonly used as security fence panels of this type and are described, for example, in GB 2 480 913 A, US 2011/0062404 A1 and ZA 2005/08877. With these, security fences are erected with the aid of posts and appropriate fastening means. In the mounted state, the wire panels generally have a smaller spacing between substantially horizontally arranged wires than between substantially vertically arranged wires.

In ZA 2006/09593, a variant of such fence panels is described, wherein the first set and the second set of wires intersect at a non-perpendicular angle.

In addition, the Applicant of the present patent application has a stronger variant of such security fence panels on the market under the name "Securifor 3D". Extra strength is here obtained by providing the security fence panels locally with a three-dimensional bend. The wires of one set are provided locally with a bend at a same place. At the level of this bend, the wires of the other set do not extend in the same plane as the wires which are arranged next to this bend.

SUMMARY

The object of the present invention is to provide an alternative stronger variant of a security fence panel of this type, which can be produced with less material in order to ensure a same level of impenetrability.

This object of the invention is achieved by providing a security fence panel, comprising a first set of wires extending substantially parallel to one another and a second set of wires extending substantially parallel to one another, wherein the wires from the first set and the second set intersect, and where these intersect, are mutually welded, and wherein a part of the first set of wires is arranged on the other side of the wires of the second set from the rest of the wires of the first set, and the wires of this part, viewed in the longitudinal direction of the wires of the second set, are arranged at a certain spacing from the rest of the wires of the first set.

Given a same number of wires as in a wire panel according to the prior art, a stronger panel is obtained by now, according to the invention, systematically providing wires from the first set alternately on one side and on the other side of the wires from the second set. The wires from the second set are preferably only in contact with wires from the first set. The wires from the first set can possibly be in contact with other elements, such as, for example, wires from an additional set of wires.

Each of the wires from that part of the first set which are disposed on the other side of the second set are arranged, viewed in the longitudinal direction of the wires of the second set, at a certain spacing from the rest of the wires of the first set.

The same amount of material hence yields stronger panels, with which, together with posts, stronger fences can be erected. As a result, in fences which comprise such panels according to the invention and which are provided with a detection system based on detecting the movement of these panels, fewer false alarms are generated, for example by playing of the panel in the wind or a bird alighting on the panel.

If it is wished to obtain fences which perform just as well as the fences according to the prior art, then this can be realized with less material.

Since the wires of a fence panel according to the invention are partially located on the rear side of a fence erected herewith, it is more difficult with ordinary hand tools to cut through or break, from the front side of the fence, the wires which are located on the rear.

In a more specific embodiment, the wires from the second set here extend in one plane. A part of the wires from the first set in this case extend in a first plane on one side of the plane of the second set of wires, whilst the rest of the wires from the first set extend in a second plane on the other side of the plane of the second set of wires. The said planes are here arranged in parallel.

In such a wire panel according to the invention, the angle at which the wires from the first set cross the wires from the second set is preferably almost 90°. Alternatively, wires can also be provided at an inclination of between 25° and 60°, and in that case preferably at about 45°.

The second set of wires of a security panel according to the present invention preferably extend, in the mounted state of the panel, substantially vertically.

The first set of wires preferably extend, in the mounted state of the panel, substantially horizontally.

In a particularly preferred embodiment of a wire panel according to the present invention, the wires of the first set are arranged alternately on both sides of the second set of wires. For each first wire, a change of side is realized. In this way, an extremely strong wire panel is obtained.

The wires from a wire panel according to the present invention preferably have a substantially round cross section. Other cross sections are conceivable, but are less preferred. The wires also preferably have a diameter of between 2 and 8 mm, so that these cannot be easily cut through. To this end, the wires are also preferably made of steel, and then more preferably as steel wire having a tensile strength of between 400 N/mm$^2$ and 700 N/mm$^2$.

The wires from the first set, viewed in the longitudinal direction of the wires from the second set, are preferably arranged at a mutual spacing of between 10 and 15 mm. More preferably, this spacing measures approximately 13 mm.

With such a spacing, it is for most persons particularly difficult to place fingers or toes between the horizontal wires, so that a wire panel of this type is difficult to climb. It is also difficult to place hand tools, such as, for example, wire cutters, between wires having such a spacing.

The wires from the second set, viewed in the longitudinal direction of the wires from the first set, are preferably arranged at a mutual spacing of between 60 and 140 mm, and then more preferably, at a spacing of between 80 and 120 mm. Still more preferably, this spacing measures approximately 102 mm.

Preferably, the spacing between the first set of wires is chosen as a function of the prevention of placement of fingers, toes or objects therebetween, whilst the spacing between the second set of wires is chosen as a function of the desired final strength of the wire panel when the given first set of wires are known.

In a particularly strong variant of a security fence panel according to the present invention, the wires from the second set, viewed at a same position in their longitudinal direction, are provided with a same bend. Such a security fence panel is then, analogously as in Securifor 3D, provided with a three-dimensional bend.

The object of the present invention is likewise achieved by providing a security fence comprising a post and an inventive security fence panel fastened to the post.

The present invention is now explained in greater detail below with reference to the following detailed description of some preferred embodiments of a security fence panel and a security fence according to the present invention. The aim of this description is solely to give illustrative examples and indicate further advantages and particularities of this fence panel and fence and thus cannot be interpreted as a limitation of the field of application of the invention or of the patent rights claimed in the claims.

BRIEF DESCRIPTION OF THE DRAWINGS

In this detailed description, reference is made by means of reference numerals to the appended drawings, wherein in FIG. 1 a part of an embodiment of a security fence according to the present invention is depicted in perspective, comprising a first embodiment of a fence panel according to the present invention.

DETAILED DESCRIPTION OF EMBODIMENTS

Figure 1:
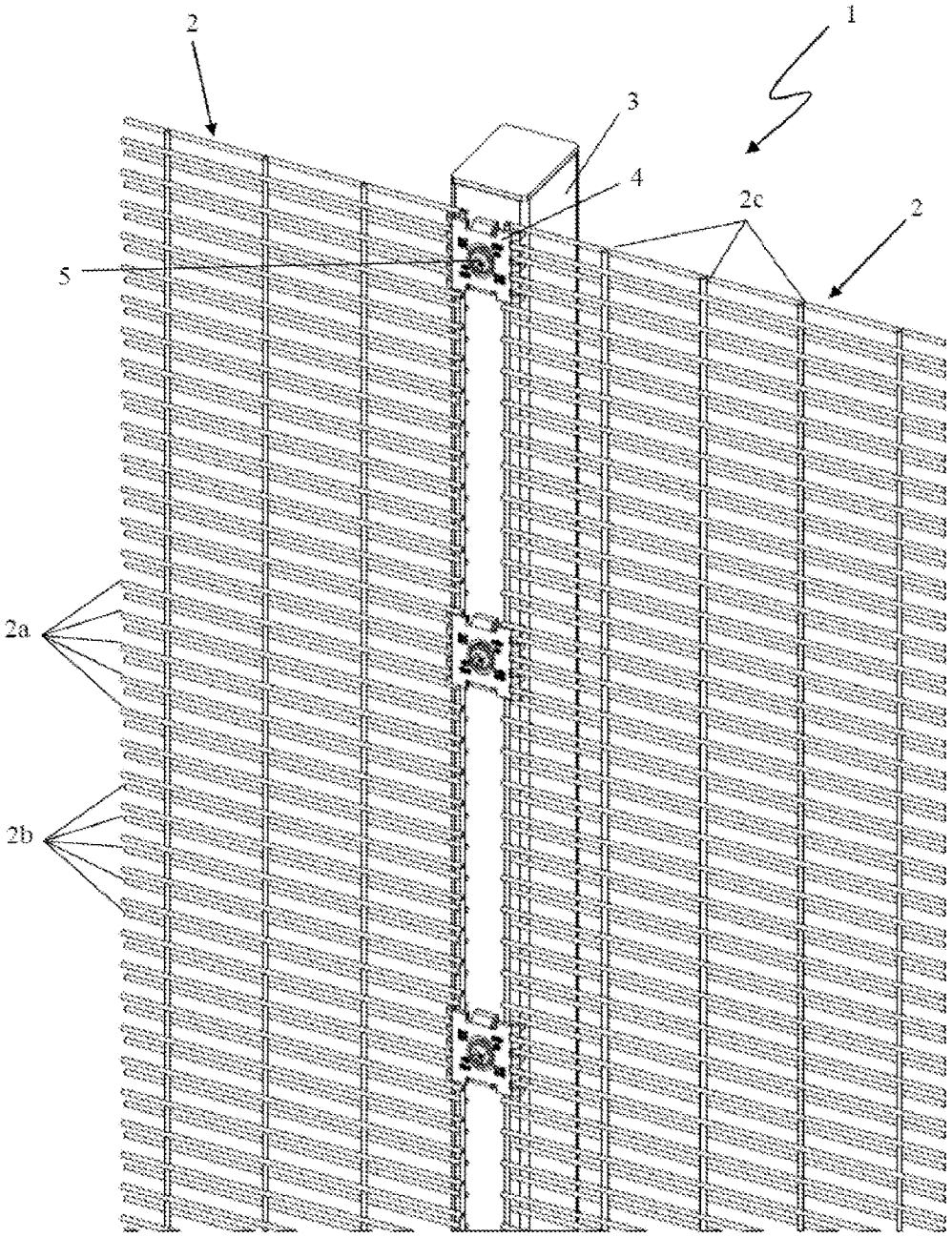
Figure 2:
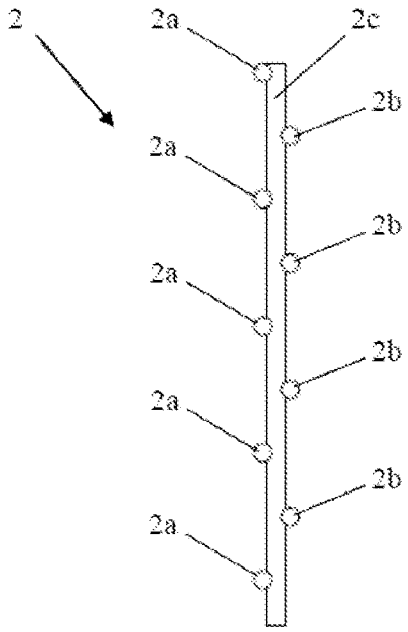
FIG. 2 a part of the first embodiment of a fence panel according to the present invention is represented in side view.

In FIGS. 1 and 2, a first embodiment of a security wire panel (2) according to the invention is depicted.

Figure 3:
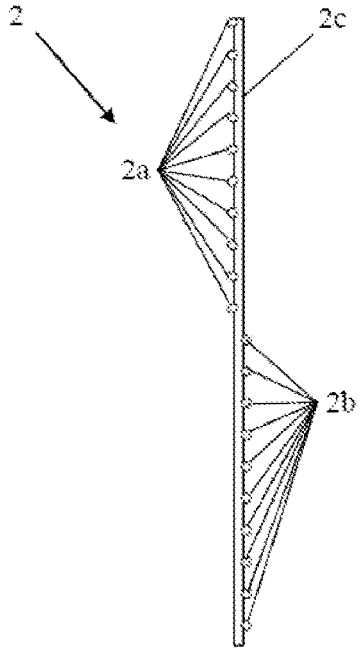
FIG. 3 a part of a second embodiment of a fence panel according to the present invention is represented in side view.

In FIG. 3, a second embodiment of a security wire panel (2) according to the invention is depicted.

Figure 4:
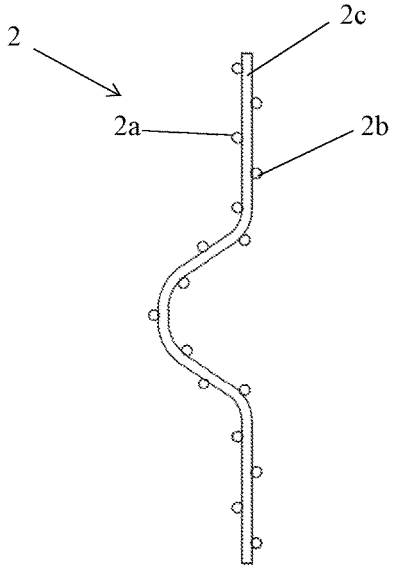
FIG. 4 a part of a third embodiment of a fence panel according to the present invention is represented in side view.

In FIG. 4, a third embodiment of a security wire panel (2) according to the invention is depicted.

Both embodiments comprise a first set of wires (2*a*, 2*b*), which in the mounted state are arranged horizontally, and a second set of wires (2*c*), which in the mounted state are arranged vertically.

The wires from the first set (2*a*, 2*b*) are in the first embodiment arranged alternately (viewed in FIG. 1) on the front side (2*a*) and on the rear side (2*b*) of the wires from the second set (2*c*) and, at the places where these cross the wires from the second set (2*c*), are welded to these wires from the second set (2*c*).

The wires from the first set (2*a*, 2*b*) are in the second embodiment arranged alternately, in 10*s*, on the front side (2*a*) and on the rear side (2*b*) of the wires from the second set (2*c*) and, at the places where these cross the wires from the second set (2*c*), are welded to these wires from the second set (2*c*).

The welding together of the wires (2*a*, 2*c*) can be realized, for example, with an automatic welding machine. The wires (2*a*, 2*c*) of the preferred embodiments are mutually welded by a TIG welding process, wherein no welding material is added and the weld joint is obtained by melting of the material of the wires (2*a*, 2*b*, 2*c*). Less preferably, a MIG welding process could also be chosen, wherein the joint is obtained by means of a welding material provided in the molten state. Resistance welding is also amongst the options.

The wires (2*a*, 2*b*, 2*c*) are made of steel having a low carbon content. The tensile strength of these steel wires (2*a*, 2*b*, 2*c*) is between 400 N/mm$^2$ and 700 N/mm$^2$. The wires (2*a*, 2*b*, 2*c*) from both embodiments have a round cross section with a diameter of between 2 and 8 mm, so that they cannot easily be cut through.

The wire panels (2) can be installed with bare and untreated wires, but the wire panels (2) can also first be galvanized. The wire panels (2) comprising bare wires (2*a*, 2*b*, 2*c*) and the galvanized wire panels (2) can also be subsequently provided with a plastics coating, with preference for polyester or PVC.

Preferably, the spacing between the horizontal wires (2*a*, 2*b*) is chosen as a function of the prevention of placement of fingers, toes or objects therebetween, whilst the spacing between the vertical wires (2*c*) is chosen as a function of the desired final strength of the wire panel (2) when the given horizontal wires (2*a*, 2*b*) are known.

The dimensions of the meshes of the most commonly found similar security panels according to the prior art, having horizontal and vertical wires, currently measure 12.7 mm (between the horizontal wires) by 76.2 mm (between the vertical wires). In order to obtain a strong panel, having the same kind of wires (2*a*, 2*b*, 2*c*), the meshes of the first embodiment of a wire panel (2) from FIGS. 1 and 2 can be realized with dimensions of 12.7 mm (between the horizontal wires) by 101.6 mm (between the vertical wires). A weight reduction of 2.5% is then hereby realized.

With equally large meshes, a panel according to the present invention becomes more than twice as strong as the most commonly found similar security panels according to the prior art.

An infinitely large number of variants of security wire panels (2) according to the invention are conceivable. Thus variants can be provided, for example, with additional end stiffening elements, as described, for example, in US 2011/0062404 A1. Variants can also, for example, be provided with additional elements, as described, for example, in GB 2 480 913 A. Furthermore, variants can be provided, for example, with a third set of wires, extending in parallel, which cross the first set of wires and are connected thereto at the level of the points of intersection. This third set of wires can here be disposed, for example, on a single side of the panel and be connected to that part of the wires from the first set which are located on this side of the second set of wires. In addition, variants can exist, for example, with variations of angles at which the wires intersect, as described, for example, in ZA 2006/09593, etc.

In FIG. 1, wire panels (2) according to the first embodiment are fastened to fence posts (3) with the aid of appropriate clamps (4) and bolts (5) in order to arrive at a security fence (1) according to the present invention. The fence posts (3) can here be disposed, for example, in concrete in the ground, or can be anchored, for example, to a base.

In FIG. 4, the wires from the second set (2*c*), viewed at a same position in a longitudinal direction, are provided with an equal bend An infinitely large number of variants of security fences (1) having fence panels (2) according to the present invention are also conceivable. Thus alternative clamps (5) can be used, or alternative fence posts (3) can be used, or the fence panels (2) can be bolted, etc., to these fence posts (3) with continuous plates which at least partially cover the corresponding side of the fence posts (3), etc.

The invention claimed is:

1. A security fence panel for a fence for protecting buildings or areas by preventing persons from getting through to these buildings or areas by breaking through or climbing over the fence using simple hand tools for a certain time, comprising:

a first set of wires extending substantially parallel to one another; and a second set of wires extending substantially parallel to one another;

wherein the wires from the first set and the second set intersect, and where the wires from the first set and the second set intersect are mutually welded;

wherein the first set of wires comprises third and fourth sets of wires, and wherein the first set of wires, viewed in the longitudinal direction of the wires from the second set, are arranged at a mutual spacing of between 10 and 15 mm; and wherein the third and fourth sets of wires are on opposite sides of the second set of wires, and wherein, along a length of the second set of wires, groups of one or more of the third set of wires and of the fourth set of wires alternate, and are spaced from one another in the longitudinal direction of the second set of wires, and are not positioned directly opposite one another across the second set of wires.

2. The security fence panel according to claim 1, characterized in that the second set of wires extend, in the mounted state of the panel, substantially vertically.

3. The security fence panel according to claim 1, characterized in that the first set of wires extend, in the mounted state of the panel, substantially horizontally.

4. The security fence panel according to claim 1, characterized in that the wires of the first set are arranged alternately on both sides of the second set of wires.

5. The security fence panel according to claim 1, characterized in that the wires have a substantially round cross section.

6. The security fence panel according to claim 5, characterized in that the wires have a diameter of between 2 and 8 mm.

7. The security fence panel according to claim 1, characterized in that the wires are made of steel.

8. The security fence panel according to claim 1, characterized in that the wires from the second set, viewed in the longitudinal direction of the wires from the first set, are arranged at a mutual spacing of between 60 and 140 mm.

9. The security fence panel according to claim 1, characterized in that the wires from the second set, viewed at a same position in a longitudinal direction of the wires from the second set, are provided with an equal bend.

10. A security fence, comprising a post and the security fence panel according to claim 1, which panel is fastened to said post.

11. A security fence, comprising one or more of the security fence panels according to claim 1 fastened to fence posts.

12. The security fence of claim 11, wherein the third set of wires comprises part of the first set of wires and the fourth set of wires comprises the rest of the wires of the first set.

13. The security fence of claim 12, wherein the security fence panels are fastened to the fence posts by clamps and bolts.

14. The security fence of claim 12, wherein the security fence panels are fastened to the fence posts with continuous plates which at least partially cover a corresponding side of the fence posts.

15. The security fence panel of claim 1, wherein the first set of wires runs along the entire height of the security fence panel.

* * * * *